US007000353B2

(12) United States Patent
Bosio

(10) Patent No.: US 7,000,353 B2
(45) Date of Patent: Feb. 21, 2006

(54) RELEASE MECHANISM FOR AN ELECTRICAL ACTUATOR USED IN SWING GATES

(75) Inventor: Giuseppe Bosio, Brescia (IT)

(73) Assignee: RIB S.r.l., Brescia (IT)

( * ) Notice: Subject to any disclaimer, the term of this patent is extended or adjusted under 35 U.S.C. 154(b) by 155 days.

(21) Appl. No.: 10/628,704

(22) Filed: Jul. 28, 2003

(65) Prior Publication Data

US 2005/0022453 A1 Feb. 3, 2005

(51) Int. Cl.
*E05F 15/04* (2006.01)

(52) U.S. Cl. ..... 49/139; 49/140; 49/340

(58) Field of Classification Search ..... 49/139, 49/140, 340, 342, 346, 343, 337; 74/89.38; 192/89.21, 69.8
See application file for complete search history.

(56) References Cited

U.S. PATENT DOCUMENTS 1,546,012 A * 7/1925 Denslinger et al. ..... 192/93 R
2,229,483 A * 1/1941 Toulmin, Jr. ..... 414/522
2,504,018 A * 4/1950 Gibson et al. ..... 192/48.1
2,592,891 A * 4/1952 Hall ..... 49/340
RE25,255 E * 10/1962 Brandt ..... 74/89.38
3,422,704 A * 1/1969 Catlett ..... 475/4
3,470,653 A * 10/1969 Kalog ..... 49/139
4,131,776 A * 12/1978 Ehrenberger ..... 200/500
4,307,795 A * 12/1981 Roy ..... 192/69.82
5,507,120 A * 4/1996 Current ..... 49/340

* cited by examiner

*Primary Examiner*—Gregory J. Strimbu

(74) *Attorney, Agent, or Firm*—McGlew & Tuttle, PC

(57) ABSTRACT

A transmission joint with a coupling having frontal teeth (20,21) is inserted between an output shaft of a gear motor and a worm screw. A release element is associated in a radial way to the coupling so that the coupling can be manually released in an emergency. The release element includes an eccentric pin that engages the coupling element in a radial way so that the coupling element can be moved from an engagement position to a release position by being turned by a lock barrel (26) with its key.

6 Claims, 3 Drawing Sheets

RELEASE MECHANISM FOR AN ELECTRICAL ACTUATOR USED IN SWING GATES

FIELD OF THE INVENTION

This invention concerns in general the field of the motorised closing systems, it concerns in particularly an electrical actuator for swing and similar gates, and it refers especially to improved control and release means for these actuators.

PRIOR ART

Electrical actuators for opening and closing swing gates are already known. At one end they are fitted to a fixed upright and at the other end to the gate to be moved. These actuators essentially include, inside a casing or protection housing, a non-reversible electrical gear motor that turns a worm screw engaging a nut screw via a transmission joint. The nut screw is fixed to a cylinder or drive rod connected in turn to the swing gate by a drive pin.

The nut screw and the drive pin arranged in this way translate axially without turning and therefore the rotation in either direction of the worm screw by way of the gear motor causes the opening and closing of the swinging gate.

In general, with the motor switched off, the command and transmission system must be mechanically non-reversible to keep the swing gate rigidly blocked so as to impede the involuntary or undesired manual movement of the same. But equally well, the transmission system must be able to be released and disconnected when desired, in order to allow to open/close the swing gate also manually in the event of an emergency, or when no power reaches the gear motor.

Also, in actuators known until today, even though the rod is enclosed in a distal part of the casing or protection housing, it generally has to operate in a protruding position as there are no specific intermediate supports. This arrangement has the drawback for the rod of being subject to bending and deviation with respect to the optimum trajectory, especially when the rod finds itself in the maximum extension position under force.

OBJECT AND A SUMMARY OF THE INVENTION

One of the objects of this invention is to provide an electrical actuator for swing gates that incorporates a drive transmission system and a release mechanism that are improved through a special arrangement and combination of the functional elements.

Another object of the invention is to propose an electrical actuator of the type and for the use cited above, in which the translating member connectable to the swing gate is supported and guided positively along its entire stroke to keep it constantly aligned with the drive screw.

According to the invention, these objects are achieved with a command and release device for an electrical actuator for swing gates including at least a transmission joint with a coupling having frontal teeth inserted between an output shaft of a gear motor and a worm screw. A release element is associated in a radial manner to the coupling for a manual disengagement of the device in the case of emergency.

BRIEF DESCRIPTION OF THE DRAWINGS

Further details of the invention are made evident from the following description with reference to the enclosed guideline and non-limiting drawings in which.

DETAILED DESCRIPTION OF THE INVENTION

Figure 2:
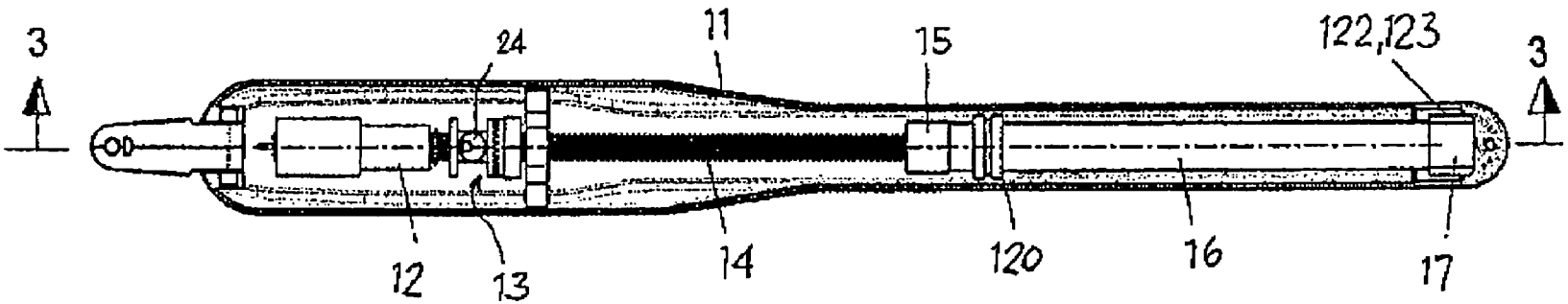
FIG. 2 shows a longitudinal section of the actuator in FIG. 1.

As represented in the drawings, the actuator includes a casing or protection housing 11 which encloses a non-reversible electrical gear motor 12 supplied with either low voltage or mains voltage. The gear motor 12 has an output shaft 12' that via a transmission coupling 13 actuates the rotation of a non-reversible worm screw 14, which engages a translating, but not rotating, nut screw 15, together with a rod or cylinder 16 also inside the casing or protective housing—FIG. 2. The rod 16 is fixed at its proximal end with the nut screw 15, whilst at its distal end it has a head 17 provided with a drive pin 18 that passes and runs in a slit 19 formed along the casing or protection housing and it connects to a swing gate to be commanded, but not represented here.

Figure 4:
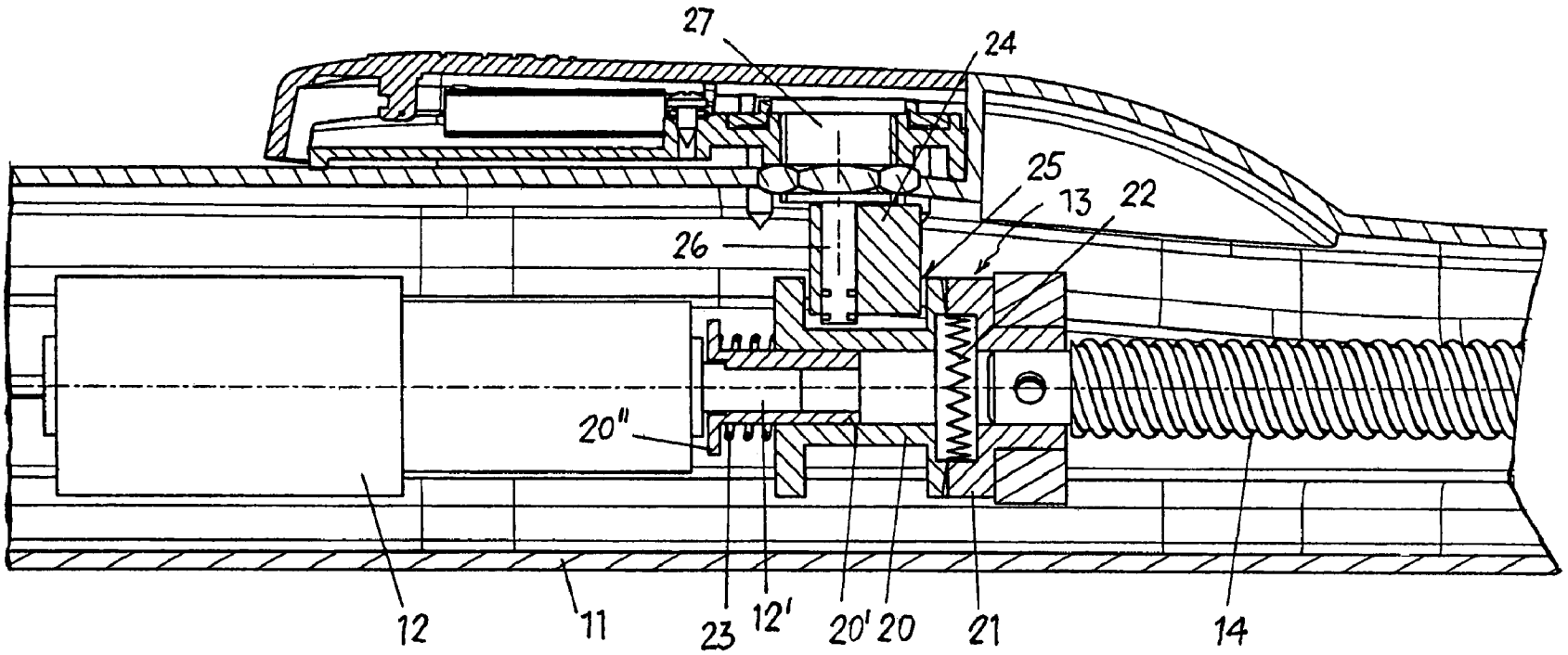
FIG. 4 shows an enlarged part of FIG. 3.

In particular, the transmission coupling 13 is composed of a drive element 20 which is keyed on and axially sliding on the output shaft 12' of the gear motor 12, with possibly the interposition of a sleeve 20', and a driven element 21 fixed at the proximal end of the worm screw 14—FIG. 4.

The drive and driven elements 20, 21 both have frontal teeth 22 for reciprocal engagement when found in a close position and that disengage from each other when moved apart. Their coming together and engaging is ensured by a thrust spring 23 associated to the drive element 20, between this and a shoulder collar 20" around the sleeve 20'. In this condition, the motor commands the worm screw to translate the drive rod and therefore moves the swing gate connected to it.

In the event of an emergency, the drive element 20 can be moved away from the driven element 21 to interrupt the transmission chain at the level of the coupling 13 so as to allow to release the swing gate for manual opening/closing.

For this interruption, the drive element 20 can be moved backwards against the action of the thrust spring 23, by way of an eccentric release pin 24, that engages an annular groove 25 around the drive element in a radial fashion. The eccentric pin 24 can be moved from an engagement blocking position of the coupling to a release position by rotating by way of a lock barrel 26 with a respective key which may be of the lobe, security type, etc.

The lock barrel 26 and the eccentric pin 24 can be reached with the key from the outside of the casing through an opening 27 that normally remains hidden by a masking element.

Figure 1:
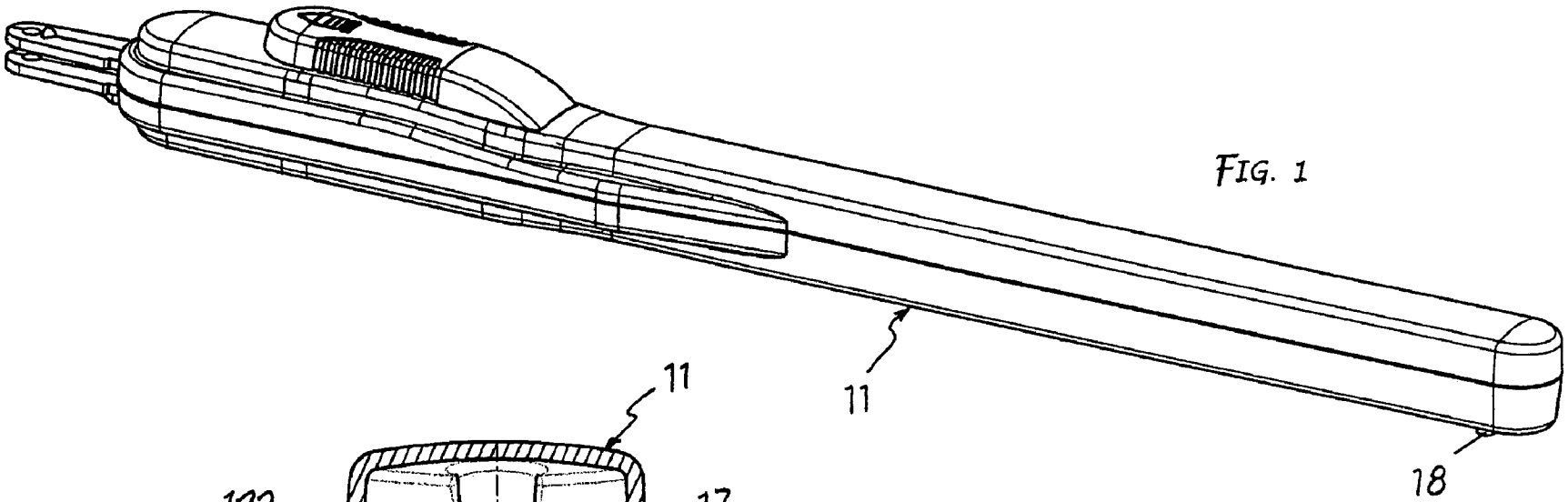
FIG. 1 shows a perspective view of the actuator of the invention.
Figure 5:
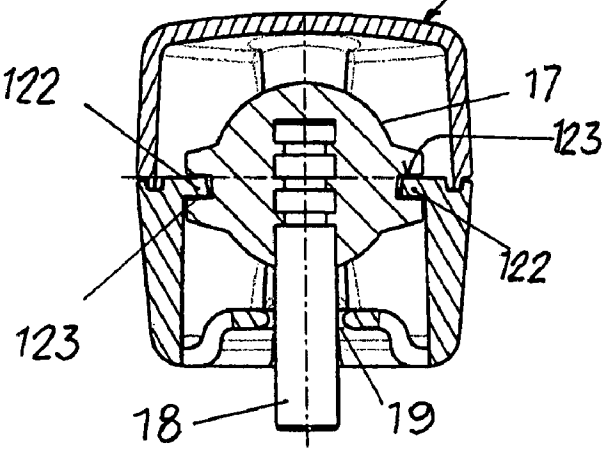
FIG. 5 shows an enlarged transverse section according to arrows 5—5 on FIG. 3.
Figure 3:
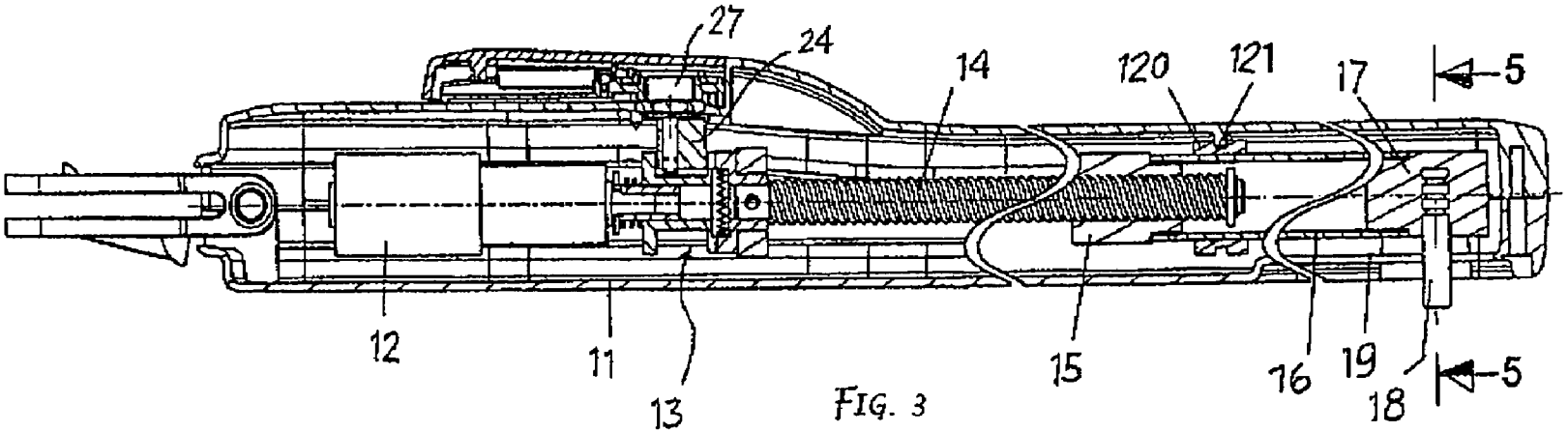
FIG. 3 shows a longitudinal section according to the arrows 3—3 on FIG. 2.

According to another aspect—FIG. 3—a centring collar 120 withheld axially in the body 11 by a stop 121 is fitted to the rod 16. Two horizontal guide ribs 122 are provided in a longitudinal direction in the casing or protection housing facing each other at least in the part corresponding to the rod 16. On opposite sides of the head 17 of the rod 16, two guide grooves 123 are created that couple with the guide ribs 122, as represented in detail in FIG. 5.

The casing or protection housing is usually composed of two complementary shells, and the guide ribs 122 are advantageously formed integrally on one of these shells thus being part of the same.

The rod is therefore supported both by the centring collar 120 and by the horizontal guides 122, 123 all along its outward and inward stroke. In this way it is never in a protruding position.

The invention claimed is:

1. An electrical actuator for a swing gate, the actuator comprising, a non-reversible electrical gear motor inside one of a casing and a protection housing, said motor actuating via a transmission joint rotation of a non-reversible worm screw that engages a nut screw, and where the nut screw has an axially translating cylindrical shaped member connected thereto, a drive pin is located on a distal end of said cylindrical shaped member, said drive pin is adapted to be fixed to the swing gate, said transmission joint including a coupling with teeth and inserted between the worm screw and an output shaft of the gear motor; a release element is radially disposed with respect to said coupling for a manual disengagement of the coupling in case of emergency;

said coupling comprising a drive element keyed onto and sliding on the output shaft of the gear motor and a driven element fixed to a proximal end of the worm screw, said drive element and said driven element both have said teeth for engagement when said drive element and said driven element are close together in an engaged condition, and said teeth are for disengagement when said drive element and said driven element are moved apart from each other;

a thrust spring is associated to the drive element to keep said drive element and said driven element of the coupling in the engaged condition, and in which the release element is coupled to said drive element to move said drive element away from the driven element to disengage the coupling;

the release element includes an eccentric pin associated with an annular groove on the periphery of the drive element, said eccentric pin being rotatable from a engagement position to a release position through rotation of a lock barrel by a respective key.

2. An electrical actuator for a swing gate, the actuator comprising, a non-reversible electrical gear motor arranged inside a casing or protection element, said motor actuating via a transmission joint rotation of a non-reversible worm screw that engages a nut screw to which an axially translating cylindrical element is connected; a drive pin is located on a distal end of said cylindrical element, said drive pin is adapted to be fixed to the swing gate; the transmission joint including a coupling with teeth inserted between the worm screw and an output shaft of the gear motor a release element is radially disposed with to said coupling for a manual disengagement of the coupling in case of emergency;

said coupling including a drive element keyed onto and sliding on said output shaft of the gear motor and a driven element fixed to a proximal end of the worm screw with said drive element and said driven element both having said teeth for engagement when said drive element and said driven element are close to each other and for release from each other when said drive element and said driven element are moved away from each other, said drive element and said driven element being biased toward each other by; and said release element including an eccentric pin that engages an annular groove arranged around the drive element, said eccentric pin being movable between an engagement position and a release position through rotation of a lock barrel by a respective key to engage and disengage said drive and driven elements.

3. The actuator according to claim 2 wherein:

said casing or protection element is provided with horizontal guides extending in a horizontal direction; and said cylindrical element slides translating rod or cylinder is centered and slides at one part in a stationary centering collar and is provided with lateral guides, that engage with the horizontal guides to support the cylindrical element through an entire translation stroke of the cylindrical.

4. The actuator according to claim 3, wherein said horizontal guides are comprised of ribs integral to one of said casing or protection element, said ribs extending generally parallel with said cylindrical element.

5. The actuator according to claim 4, wherein said centering collar is held axially in the one of the casing or protection and wherein said lateral guides are on opposite sides of the cylindrical.

6. The actuator according to claim 3, wherein said centering collar is held axially in said one of said casing or protection element, and wherein said lateral guides are on opposite sides of the cylindrical element.

* * * * *